United States Patent [19]

Allen et al.

[11] Patent Number: 4,751,910

[45] Date of Patent: Jun. 21, 1988

[54] FLUE GAS/COMBUSTION AIR HEAT EXCHANGER

[75] Inventors: Thomas E. Allen; Patrick B. Sowada, both of Clarksville, Tenn.

[73] Assignee: American Standard Inc., New York, N.Y.

[21] Appl. No.: 20,931

[22] Filed: Mar. 2, 1987

[51] Int. Cl.[4] ..... F24H 3/12

[52] U.S. Cl. ..... 126/117; 126/110 R; 126/112; 237/55; 237/53

[58] Field of Search ..... 126/117, 110 R, 112, 126/77; 237/55, 53

[56] References Cited

U.S. PATENT DOCUMENTS

| | | | |
|---|---|---|---|
| 1,725,906 | 8/1929 | Gay | 126/117 X |
| 1,777,065 | 9/1930 | Yale . | |
| 1,785,334 | 12/1930 | Black . | |
| 1,789,401 | 1/1931 | Davy . | |
| 2,319,711 | 5/1943 | Van Almelo | 431/215 X |
| 2,466,868 | 4/1949 | Scott et al. | 126/117 X |
| 3,307,471 | 3/1967 | Gacioch | 98/62 |
| 3,429,307 | 2/1969 | Eubanks | 126/94 |
| 3,643,646 | 2/1972 | Honaker, Jr. | 126/85 |
| 4,020,822 | 5/1977 | Harris | 126/110 |
| 4,122,999 | 10/1978 | Belcastro | 126/117 X |
| 4,160,440 | 7/1979 | Barnickle | 126/110 R |
| 4,171,089 | 10/1979 | Schossow | 126/112 X |
| 4,364,514 | 12/1982 | Toporek | 237/55 |
| 4,466,358 | 8/1984 | Christian | 126/112 X |
| 4,477,019 | 10/1984 | Breitbach | 236/100 |
| 4,524,754 | 6/1985 | Schubert | 126/110 R |

*Primary Examiner*—Larry Jones

*Attorney, Agent, or Firm*—William J. Beres; David L. Polsley; Robert J. Harter

[57] ABSTRACT

A flue gas/combustion air heat exchanger for a furnace. The furnace includes a combustion chamber that burns a mixture of fuel and combustion air to produce heat for a comfort zone. The resulting products of combustion, along with any waste heat not transferred to the zone, pass through a flue duct before venting to atmosphere. Incoming combustion air is discharged across the relatively hot flue duct before it enters the combustion chamber. In passing across the hot flue duct, the incoming air is preheated by waste heat of the combustion products. The heat exchange relation between the incoming combustion air and the combustion products within the flue duct enables the furnace to recover waste heat that would otherwise be lost if the combustion products were free to discharge to atmosphere before giving up a portion of their waste heat to the incoming combustion air.

9 Claims, 3 Drawing Sheets

FLUE GAS/COMBUSTION AIR HEAT EXCHANGER

TECHNICAL FIELD

The invention generally pertains to a furnace, and specifically pertains to a furnace having its products of combustion in heat exchange relationship with its intake combustion air.

BACKGROUND OF THE INVENTION

Furnaces having combustion chambers usually transfer their heat of combustion to supply air by means of a clamshell type heat exchanger. The heated supply air is then conveyed to any rooms that need heat. However, a substantial amount of heat is often wasted because the products of combustion comprising flue gas are still relatively hot as they exhaust to atmosphere from the clamshell heat exchanger. Therefore, attempts have been made to recover this waste heat to improve the overall efficiency of the furnace.

U.S. Pat. No. 4,020,822 shows one method of recovering this waste heat by placing the flue gas in heat exchange relation with the incoming supply air. With this method, the flue gas preheats the supply air before it passes across the clamshell heat exchangers and into the rooms needing heat. However, redirecting the supply air flow across a flue gas heat exchanger can often involve a major redesign of a conventional furnace.

Another heat recovery method, which has often been overlooked, involves using the flue gas to preheat the intake combustion air. U.S. Pat. Nos. 3,307,471 and 3,429,307 both show a flue gas passage adjacent to a combustion air passage. Neither patent, however, mentions any heat exchange relation between the two, nor makes any attempt to take full advantage of their proximity since they are positioned adjacent to each other for purposes other than for heat transfer. The '471 patent even includes insulation (Item 65 of FIG. 5) that insulates a potential heat exchange surface that could otherwise be used to preheat combustion air.

Other methods, such as those disclosed in U.S. Pat. Nos. 1,785,334; 1,789,401; and 4,364,514 include separately mounted, elaborate heat exchangers rather than simply making use of existing conventional flue ducts which are internally mounted within the furnace enclosure.

In view of the shortcomings of earlier methods, it is an object of the subject invention to take advantage of the temperature differential between the hot flue gas and relatively cool intake combustion air by placing them in heat exchange relation with each other.

Another object is to increase the heating efficiency of a furnace by recovering heat from hot combustion flue gas that would otherwise be wasted.

Another object is to preheat the intake combustion air entering the combustion chamber of the furnace.

Yet another object is to provide a flue gas/combustion air heat exchanger that is disposed inside the furnace enclosure.

A further object is to use a conventional flue gas duct to not only convey flue gas in a direct, non-tortuous path for minimal flow resistance, but also to function as a heat exchanger.

A still further object is to position a combustion air blower such that is discharges across a hot flue gas duct in a direct, non-tortuous path for minimal flow resistance.

SUMMARY OF THE INVENTION

The subject invention is a furnace having a combustion chamber for burning a mixture of fuel and combustion air. Combustion products are exhausted to atmosphere after passing through a flue duct which extends through the interior of the furnace. The furnace includes a combustion air blower having a discharge directed across the flue gas duct inside the furnace, so that incoming combustion air discharged across the flue duct is preheated by the combustion products before entering the combustion chamber.

DESCRIPTION OF THE PREFERRED EMBODIMENT

Figure 1:
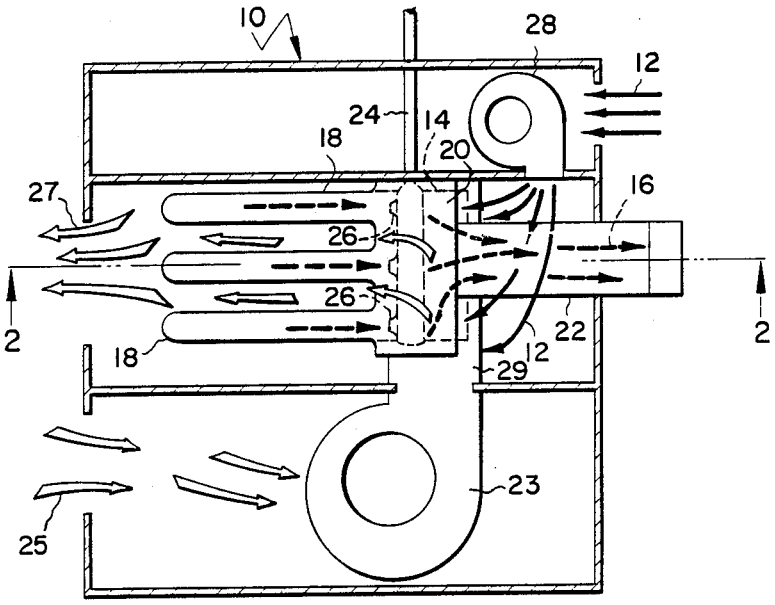
FIG. 1 is a cutaway top view of FIG. 2 taken along line 1—1 showing a furnace including the subject invention as described in the first embodiment.
Figure 2:
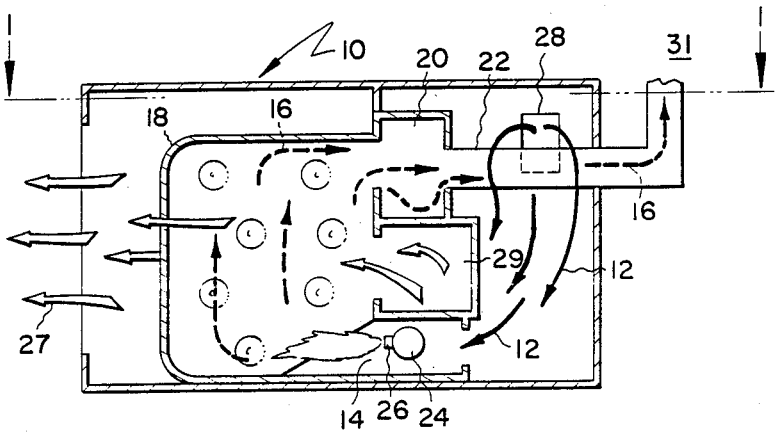
FIG. 2 is a cutaway front view taken along line 2—2 of FIG. 1.

FIGS. 1 and 2 show a furnace 10 incorporating the subject invention as described by the preferred embodiment. Furnace 10 burns a mixture of fuel and combustion air 12 inside a combustion chamber 14. A major portion of the heat from the products of combustion are used to heat at least one comfort zone (not shown), while the remaining portion is considered waste heat. In furnace 10, some of the waste heat is recovered by a novel heat exchange relationship between incoming combustion air 12 and the exhausted products of combustion, comprising flue gas 16. The details of the novel heat exchange relationship and the various fluid flow patterns through furnace 10 are described below.

Combustion chamber 14 receives a fluid fuel, such as oil or gas, from a fule line 24 connected to an outside source of fuel (not shown). The fuel discharges into combustion chamber 14 through burner nozzles 26 which extend from fuel line 24. In combustion chamber 14, the fuel mixes with combustion air 12 supplied by a combustion air blower 28. The combustible fuel/air mixture burns to produce hot combustion products.

The hot combustion products rise from combustion chamber 14 and pass through the interior of a set of parallel connected heat exchangers 18. Although heat exchangers 18 are of the clamshell type, various other type heat exchangers could also be used. It should also be noted that combustion chamber 14 can be considered as an integral part of heat exchangers 18. By means of heat exchangers 18, the combustion products give up much of their heat to a current of air which is supplied to the comfort zone. The current of air is developed by centrifugal blower 23 which draws relatively cool return air 25 from the zone, discharges it into a supply air box 29, across the exterior of heat exchangers 18, and returns it back to the zone as heated supply air 27.

Flue gas 16 gives up much of its heat as a result of passing through the interior of heat exchangers 18. Still carrying an appreciable amount of waste heat, flue gas 16 combines into a common discharge path within flue box 20. From flue box 20, the hot flue gas 16 enters a conventional sheet metal flue duct 22 where it is conveyed through the interior of furnace 10 before being vented to atmosphere 31.

Combustion air blower 28 is mounted so that it discharges incoming combustion air 12 across and completely around flue duct 22. Although flue duct 22 is made of sheet metal, it could also be made of any other good heat conductive material which assures a heat transfer relation between the incoming combustion air 12 and hot flue gas 16. Combustion air 12 is heated as it passes across the relatively hot flue duct 22 and thus recovers heat that would otherwise be wasted if flue gas 16 were allowed to vent to atmosphere 31 before giving up a portion of its heat to the incoming combustion air 12.

Figure 3:
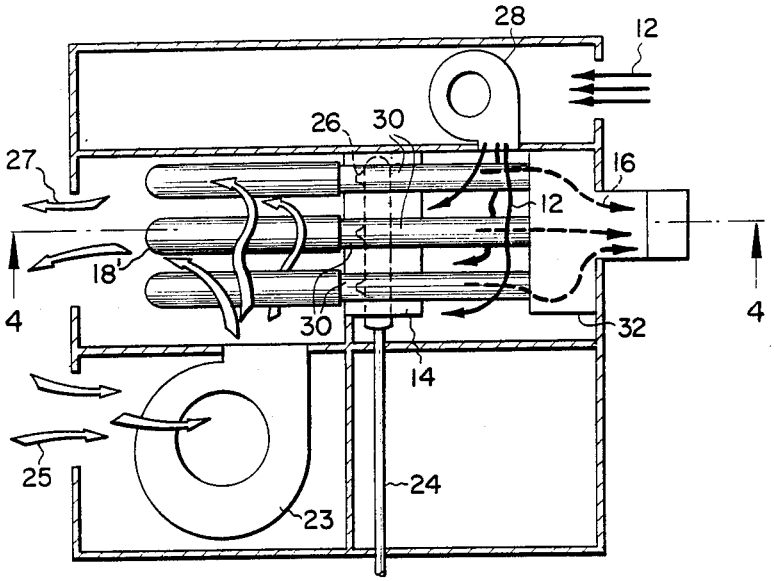
FIG. 3 is a cutaway top view of FIG. 4 taken along line 3—3 showing a furnace including the subject invention as described in the second embodiment.
Figure 4:
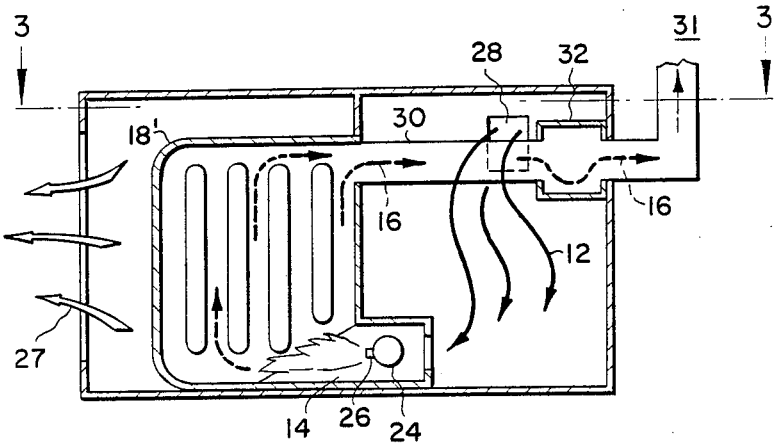
FIG. 4 is a cutaway front view taken along line 4—4 of FIG. 3.

In a second embodiment of the invention, illustrated in FIGS. 3 and 4, heat exchangers 18′ discharge flue gas into its own separate flue duct 30. The flue gas 16 conveyed through each flue duct 30 is combined into a common flue box 32 before being vented to atmosphere 31. Similar to the first embodiment, blower 28 discharges incoming combustion air 12 across the hot flue ducts 30, in heat exchange relation therewith to recover the waste heat of the hot flue gas 16.

Figure 5:
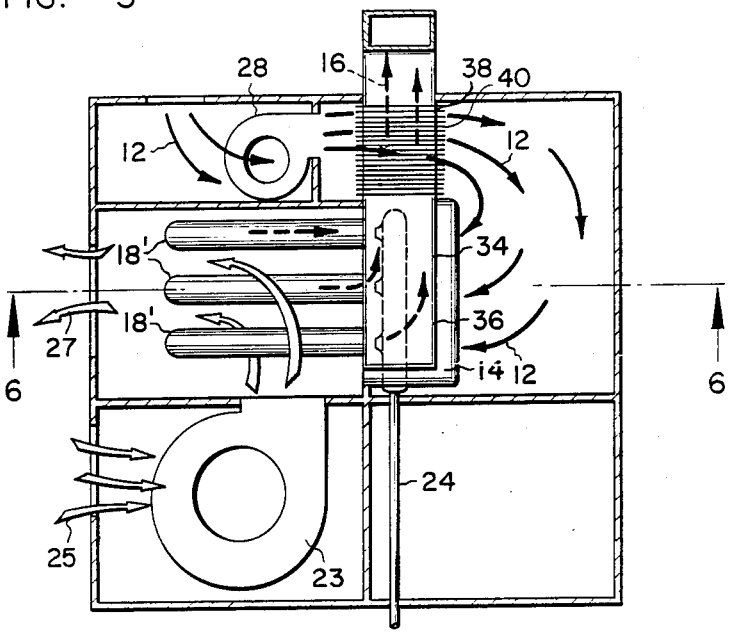
FIG. 5 is a cutaway top view of FIG. 6 taken along line 5—5 showing a furnace including the subject invention as described in the third embodiment.
Figure 6:
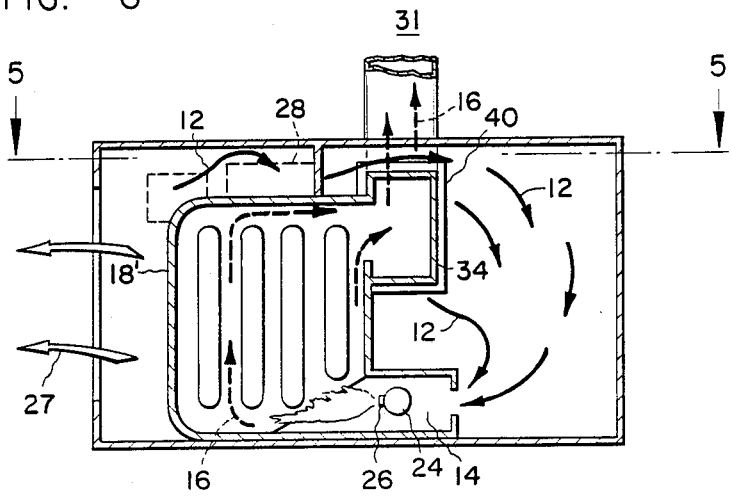
FIG. 6 is a cutaway front view taken along line 6—6 of FIG. 5.

In a third embodiment of the invention, combustion air 12 and hot flue gas 16 flow through the furnace as shown in FIGS. 5 and 6. An exhaust duct 34, having a generally uniform cross section, extends across the discharge of heat exchangers 18′ and further extends through the furnace to convey flue gas 16 to atmosphere 31. The portion of exhaust duct 34 that extends across the discharge heat exchangers 18′ comprises a flue box 36 which provides the same function as flue box 20 and 32, i.e., to collect the flue gas discharged from at least one heat exchanger and direct it into a common discharge path. The remaining portion of exhaust duct 34 which extends through the furnace comprises a flue duct 38. Again, as in the other embodiments, blower 28 discharges combustion air 12 across the hot surface of flue duct 38, in heat exchange relation therewith, to recover the waste heat of the hot flue gas 16 which is about to be vented to atmosphere 31.

In each of the embodiments described above, three parallel connected exchangers 18 or 18′ have been shown, however, it should be appreciated by those skilled in the art, that the three heat exchangers represent any arrangement having at least one heat exchanger. It should also be appreciated that the heat exchange relation between combustion air 12 and flue gas 16 can be enhanced by providing the surface of the flue duct 22, 30, or 38 with heat transfer fins 40, as shown in FIGS. 5 and 6. Fins 40 are just one example of a wide variety of other fin configurations that would work equally well.

Although the invention is described with respect to more than one embodiment, further modifications thereto will be apparent to those skilled in the art. Therefore, the scope of the invention is to be determined by reference to the claims which follow.

We claim:

1. A furnace comprising:

a. a combustion chamber disposed inside a furnace enclosure for burning a mixture of fluid fuel and combustion air, thereby producing heat and combustion products;

b. at least one heat exchanger disposed inside said furnace enclosure and having both an inlet to receive said combustion products from said combustion chamber and also an outlet to discharge said combustion products;

c. a supply air blower disposed inside said furnace enclosure for discharging supply air across said heat exchanger in heat exchange relation with said combustion products;

d. a flue box disposed inside said furnace enclosure and connected to both collect said combustion products which have been discharged from said heat enchanger and to combine said discharged combustion products into a common discharge path;

e. a flue duct disposed inside said furnace enclosure and connected to and in series with said flue box to convey said combustion products through the interior of said furnace; and f. a combustion air blower disposed inside said furnace enclosure and having a discharge directed across an exterior surface of said flue duct, such that combustion air discharged from said blower is guided and conveyed by said furnace enclosure to pass across and encircle an exterior surface of said flue duct in a generally forward nonreversing flow pattern and subsequently conveyed by said enclosure in a generally downward direction to said combustion chamber, thereby preheating said combustion air before it enters said combustion chamber.

2. The furnace as recited in claim 1, wherein said combustion air discharged from said blower flows around said flue duct in a direction generally perpendicular to the direction that the combustion products are being conveyed through said flue duct.

3. The furnace as recited in claim 1, wherein said flue duct conveys said combustion products from said flue box to the exterior of said furnace.

4. The furnace as recited in claim 1, wherein a cross-sectional area of said flue box is generally equal to a cross-sectional area of said flue duct.

5. The furnace as recited in claim 1, wherein said flue duct includes heat conductive fins to enhance heat transfer from said flue duct to said combustion air.

6. A furnace comprising:

a. a combustion chamber disposed inside a furnace enclosure for burning a mixture of fluid fuel and combustion air, thereby producing heat and combustion products;

b. A plurality of generally vertical, parallel connected heat exchangers disposed inside said furnace enclosure, said heat exchangers having an inlet and an outlet for conveying combustion products in a generally upward direction from said combustion chamber to said outlet;

c. a supply air blower disposed inside said furnace enclosure for discharging supply air in a generally horizontal direction across said heat exchangers in heat exchange relation with said combustion products;

d. a flue box disposed inside said furnace enclosure and directly connected to said outlet of said heat exchangers to both collect said combustion products discharged from said heat exchangers and to combine said discharge combustion products into a common discharge path;

e. a maximum of three metal flue ducts disposed inside said furnace enclosure and connected to said flue box to convey said combustion products through the interior of said furnace enclosure from said flue box to the exterior of said furnace; and f. a combustion air blower disposed inside said furnace enclosure and positioned to discharge combustion air generally toward an exterior surface of said flue ducts, such that combustion air discharged from said blower is guided and conveyed by said furnace enclosure to pass across and encircle said exterior surface of said flue duct in a generally forward nonreversing flow pattern and subsequently conveyed by said enclosure in a generally downward direction to said combustion chamber, thereby preheating said combustion air before it enters said combustion chamber.

7. The furnace as recited in claim 6, wherein said combustion air discharged from said blower flows around said flue duct in a direction generally perpendicular to the direction that the combustion products are being conveyed through said flue duct.

8. The furnace as recited in claim 6, wherein a cross-sectional area of said flue box is generally equal to a cross-sectional area of said flue duct.

9. The furnace as recited in claim 6 wherein said flue duct includes heat conductive fins to enhance heat transfer from said flue duct to said combustion air.

* * * * *